US010504414B2

(12) United States Patent
Yang et al.

(10) Patent No.: US 10,504,414 B2
(45) Date of Patent: Dec. 10, 2019

(54) IMAGE PROCESSING APPARATUS AND METHOD FOR GENERATING DISPLAY DATA OF DISPLAY PANEL

(71) Applicant: Novatek Microelectronics Corp., Hsinchu (TW)

(72) Inventors: Hsueh-Yen Yang, Taoyuan (TW); Ching-Pei Cheng, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 27 days.

(21) Appl. No.: 15/975,796

(22) Filed: May 10, 2018

(65) Prior Publication Data

US 2018/0330657 A1 Nov. 15, 2018

Related U.S. Application Data

(60) Provisional application No. 62/504,519, filed on May 10, 2017.

(51) Int. Cl.
*G09G 3/20* (2006.01)

(52) U.S. Cl.
CPC ..... *G09G 3/2092* (2013.01); *G09G 3/2003* (2013.01); *G09G 2300/0452* (2013.01); *G09G 2340/02* (2013.01); *G09G 2340/0457* (2013.01); *G09G 2370/08* (2013.01)

(58) Field of Classification Search
CPC ..... G09G 3/2092; G09G 3/2003; G09G 2300/0452; G09G 2340/02; G09G 2340/0457; G09G 2370/08; G09G 2320/0242
See application file for complete search history.

(56) References Cited

U.S. PATENT DOCUMENTS 8,031,205 B2 10/2011 Brown Elliott et al.
8,872,869 B2 * 10/2014 Damera-Venkata ..... G09G 3/007 345/629
2003/0034992 A1 * 2/2003 Brown Elliott ..... G06T 3/4015 345/690

(Continued)

OTHER PUBLICATIONS

Sheng-Tien Cho et al., "Image processing method and related apparatus", Unpublished U.S. Appl. No. 15/673,432 , filed Aug. 10, 2017.

(Continued)

*Primary Examiner* — Tom V Sheng
(74) *Attorney, Agent, or Firm* — JCIPRNET

(57) ABSTRACT

An image processing apparatus including an image data processing unit is provided. The image data processing unit is configured to generate an output frame according to an input frame. For any one of sub-pixels of a display panel, the image data processing unit performs a sub-pixel rendering operation on a part of input sub-pixel data of the input frame to generate an output sub-pixel data corresponding to said any one of sub-pixels in the output frame. The output sub-pixel data is written into said any one of sub-pixels. Data positions that the parts of input sub-pixel data of different input frames locate in respective input frames are partially overlapped and not totally the same. In addition, a method for generating display data of the display panel is provided.

8 Claims, 16 Drawing Sheets

(56) References Cited

U.S. PATENT DOCUMENTS

| | | | | |
|---|---|---|---|---|
| 2003/0085906 | A1* | 5/2003 | Elliott | G09G 3/20 345/613 |
| 2010/0118045 | A1* | 5/2010 | Brown Elliott | G02B 27/2214 345/589 |
| 2010/0277498 | A1 | 11/2010 | Elliott et al. | |
| 2013/0148060 | A1* | 6/2013 | Kim | G02F 1/133514 349/106 |
| 2013/0222442 | A1* | 8/2013 | Gu | G09G 5/02 345/694 |
| 2016/0240593 | A1* | 8/2016 | Gu | G09G 3/3225 |
| 2017/0098432 | A1* | 4/2017 | Heo | G09G 3/2074 |
| 2017/0103696 | A1* | 4/2017 | Li | G09G 3/2074 |

OTHER PUBLICATIONS

Hsueh-Yen Yang et al., "Electronic Apparatus, Display Driver and Method for Generating Display Data of Display Panel", Unpublished U.S. Appl. No. 15/806,327, filed Nov. 8, 2017.

Hsueh-Yen Yang et al., "Image Processing Apparatus, Display Panel and Display Apparatus", Unpublished U.S. Appl. No. 15/806,346, filed Nov. 8, 2017.

* cited by examiner

IMAGE PROCESSING APPARATUS AND METHOD FOR GENERATING DISPLAY DATA OF DISPLAY PANEL

CROSS-REFERENCE TO RELATED APPLICATION

This application claims the priority benefit of U.S. provisional application Ser. No. 62/504,519, filed on May 10, 2017. The entirety of the above-mentioned patent application is hereby incorporated by reference herein and made a part of this specification.

BACKGROUND OF THE INVENTION

1. Field of the Invention

The invention relates to an image processing apparatus and a method for generating display data of a display panel.

2. Description of Related Art

With blooming development in display technology, market demands for performance requirements of a display panel are advancements in high resolution, high brightness and low-power consumption. However, with improved resolution of the display panel, because the number of sub-pixels on the display panel will also increase for displaying in high resolution, the manufacturing cost is also increased accordingly. In order to reduce the manufacturing cost of the display panel, a sub-pixel rendering method (SPR method) has been proposed. A display apparatus generally uses different arrangements and designs of the sub-pixels to formulate a proper algorithm so an image resolution visible by human eyes (i.e., a visual resolution) can be improved.

Besides, in comparison with a data quantity of pixel data not processed by the SPR method, the pixel data processed by the SPR method can provide a reduced data quantity, which is conducive to data transmission. In addition, a suitable sub-pixel rendering can prevent an image display quality from being reduced.

SUMMARY OF THE DISCLOSURE

The invention is directed to an image processing apparatus and a method for generating a display data of a display panel, with a data processing including a sub-pixel rendering operation capable of reducing a data transmission amount.

The image processing apparatus of the invention includes an image data processor unit. The image data processor unit is configured to generate a first output frame according to a first input frame and generate a second output frame according to a second input frame. The first output frame and the second output frame are displayed on the display panel. The second input frame is an input frame temporally subsequent to the first input frame. For any one of sub-pixels in a pixel row of the display panel, the image data processor unit performs the sub-pixel rendering operation on a first part of input sub-pixel data of the first input frame to generate a first output sub-pixel data corresponding to said any one of sub-pixels in the first output frame. For said any one of sub-pixels in the pixel row of the display panel, the image data processor unit performs the sub-pixel rendering operation on a second part of input sub-pixel data of the second input frame to generate a second output sub-pixel data corresponding to said any one of sub-pixels in the second output frame. Data positions of the first part of input sub-pixel data in the first input frame and data positions of the second part of input sub-pixel data in the second input frame are partially overlapped and not totally the same.

In an embodiment of the invention, the sub-pixel rendering operation includes calculating the first part of input sub-pixel data of the same color or the second part of input sub-pixel data of the same color by the image data processor unit according to a set of color diffusion ratios to generate the first output sub-pixel data or the second output sub-pixel data corresponding to said any one of sub-pixels.

In an embodiment of the invention, the image processing apparatus further includes an image compression unit. The image compression unit is configured to compress the first output frame and compress the second output frame. The image compression unit outputs the compressed first output frame and the compressed second output frame.

In an embodiment of the invention, the image processing apparatus further includes a processor. The image data processor unit and the image compression unit are disposed in the processor. The processor outputs the compressed first output frame and the compressed second output frame to a display driver.

In an embodiment of the invention, the image processing apparatus further includes an image decompression unit, which is configured to decompress the compressed first output frame and the compressed second output frame to generate the decompressed first output frame and the decompressed second output frame.

In an embodiment of the invention, the image processing apparatus further includes a display driver. The image data processor unit, the image compression unit and the image decompression unit are disposed in the display driver. The display driver drives the display panel according to the decompressed first output frame and the decompressed second output frame.

The method for generating the display data of the display panel of the invention includes: generating a first output frame according to a first input frame, wherein for any one of sub-pixels in a pixel row of the display panel, a sub-pixel rendering operation is performed on a first part of input sub-pixel data of the first input frame to generate a first output sub-pixel data corresponding to the sub-pixel in the first output frame; and generating a second output frame according to a second input frame, wherein for said any one of sub-pixels in the pixel row of the display panel, the sub-pixel rendering operation is performed on a second part of input sub-pixel data of the second input frame to generate a second output sub-pixel data corresponding to said any one of sub-pixels in the second output frame. The first output frame and the second output frame are displayed on the display panel. The second input frame is an input frame temporally subsequent to the first input frame. Data positions of the first part of input sub-pixel data in the first input frame and data positions of the second part of input sub-pixel data in the second input frame are partially overlapped and not totally the same.

In an embodiment of the invention, the sub-pixel rendering operation includes calculating the first part of input sub-pixel data of the same color or the second part of input sub-pixel data of the same color according to a set of color diffusion ratios to generate the first output sub-pixel data or the second output sub-pixel data corresponding to said any one of sub-pixels.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
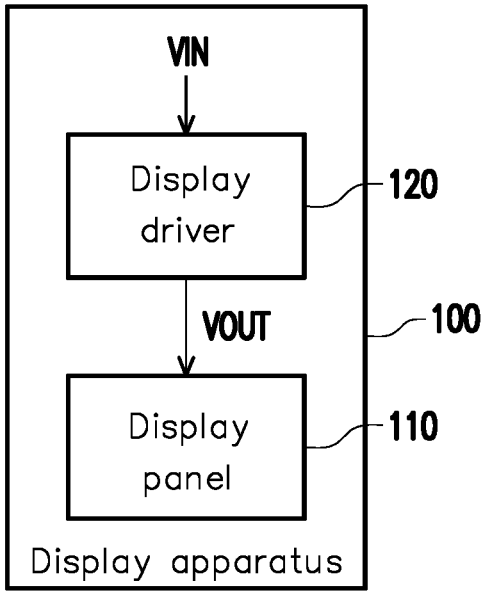
FIG. 1 is a schematic diagram illustrating a display apparatus in an embodiment of the invention.

Reference will now be made in detail to the present preferred embodiments of the invention, examples of which are illustrated in the accompanying drawings.

Wherever possible, the same reference numbers are used in the drawings and the description to refer to the same or like parts.

FIG. 1 is a schematic diagram illustrating a display apparatus in an embodiment of the invention. With reference to FIG. 1, a display apparatus 100 of this embodiment includes a display panel 110 and a display driver 120. The display panel 110 is coupled to the display driver 120. The display apparatus 100 of FIG. 1 is, for example, an electronic apparatus such as cell phone, a tablet computer or notebook computer, which may include an image input unit. Further, the display driver 120 sequentially receives a plurality of input frames VIN from the image input unit. In this embodiment, the display driver may be regarded to as an image data processing apparatus. The display driver 120 includes, for example, an image data processor unit, which is configured to perform a sub-pixel rendering operation on each input frame VIN, so as to generate a corresponding output frame VOUT. The display driver 120 drives the display panel 110 according to the output frame VOUT. In this embodiment, the display panel 110 is, for example, a display panel such as a liquid crystal display panel or an organic light-emitting diode panel, but the type of the display panel 110 is not particularly limited in the invention.

Figures 2A, 2B, 2C:
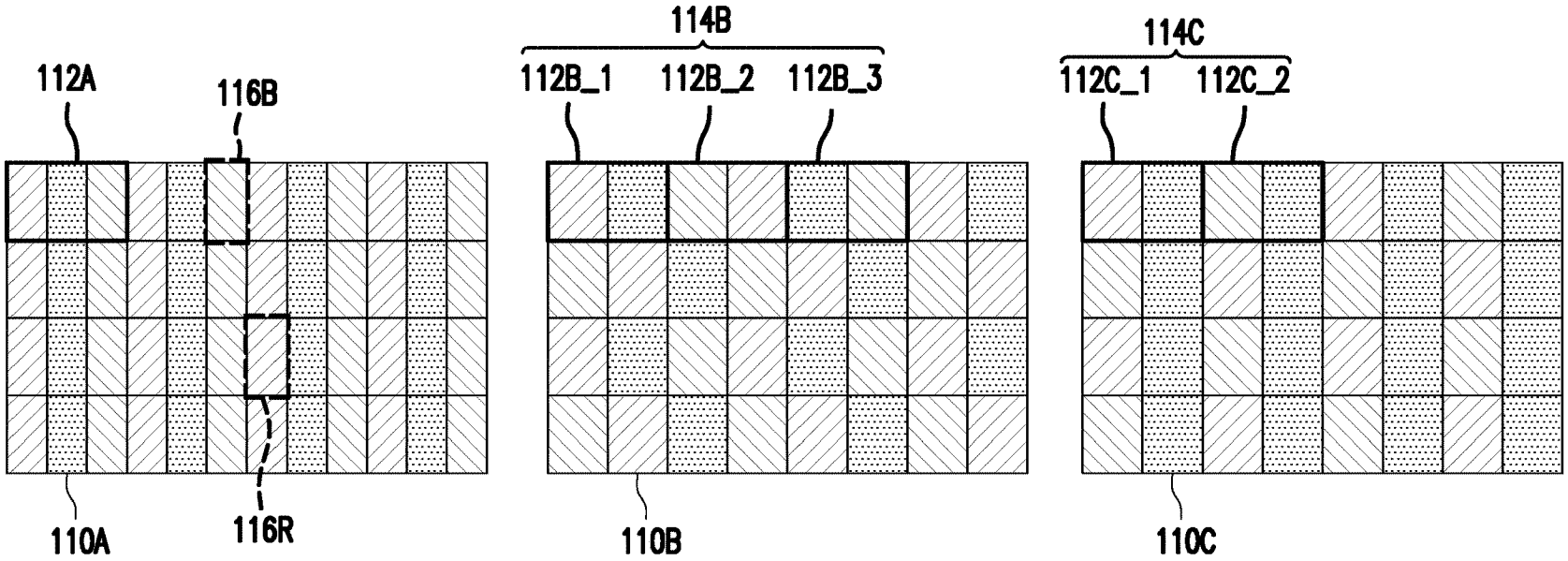
FIG. 2A, FIG. 2B and FIG. 2C are schematic diagrams illustrating pixel arrangements of a display panel in the embodiment of FIG. 1.

FIG. 2A to FIG. 2C are schematic diagrams illustrating pixel arrangements of a display panel in the embodiment of FIG. 1. A display panel 110A illustrated in FIG. 2A is, for example, a full color display panel. Each pixel 112A in the display panel 110A includes sub-pixels in three colors, which are red, green and blue. Herein, each pixel is a pixel repeating unit, repeatedly arranged to form the display panel 110A. A display panel 110B illustrated in FIG. 2B is, for example, an exemplary embodiment of a sub-pixel rendering (SPR) display panel. The display panel 110B includes a pixel repeating unit 114B. The pixel repeating unit 114B is repeatedly arranged to form the display panel 110B. The pixel repeating unit 114B includes a pixel 112B_1, a pixel 112B_2 and a pixel 112B_3. The pixel 112B_1 includes a red sub-pixel and a green sub-pixel. The pixel 112B_2 includes a blue sub-pixel and the red sub-pixel. The pixel 112B_3 includes the green sub-pixel and the blue sub-pixel. A display panel 110C illustrated in FIG. 2C is, for example, another exemplary embodiment of the SPR display panel. The display panel 110C includes a pixel repeating unit 114C. The pixel repeating unit 114C is repeatedly arranged to form the display panel 110C. The pixel repeating unit 114C includes a pixel 112C_1 and a pixel 112C_2. The pixel 112C_1 includes a red sub-pixel and a green sub-pixel. The pixel 112C_2 includes a blue sub-pixel and the green sub-pixel. In the exemplary embodiments of the invention, the type of the SPR display panel is not limited by those illustrated in FIG. 2B and FIG. 2C.

Figure 3A:
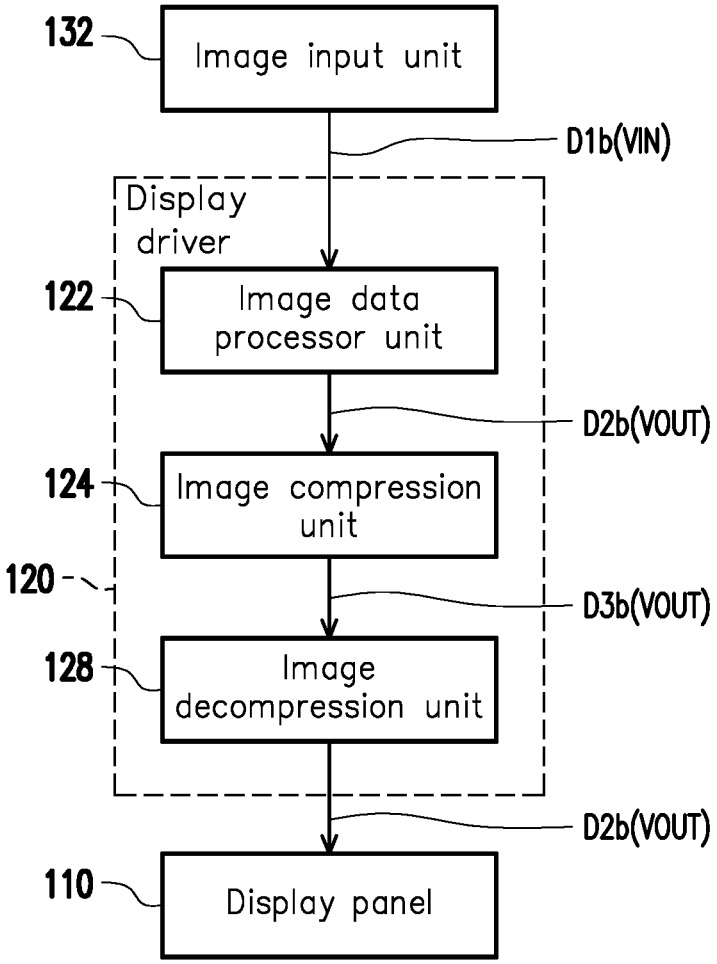
FIG. 3A is a schematic diagram of the display driver in the embodiment of FIG. 1.
Figure 3B:
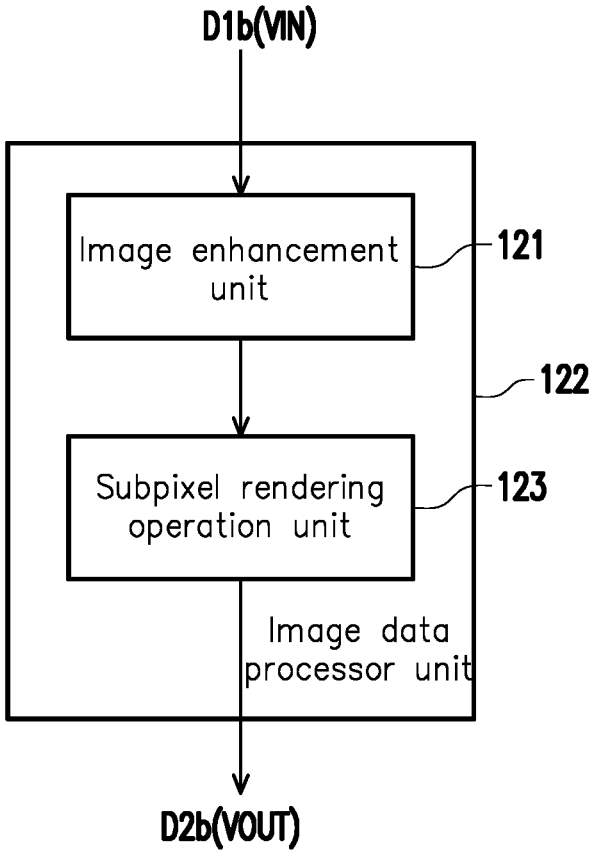
FIG. 3B is a schematic diagram of an image data processor unit in the embodiment of FIG. 3A.

FIG. 3A is a schematic diagram of the display driver in the embodiment of FIG. 1. FIG. 3B is a schematic diagram of an image data processor unit in the embodiment of FIG. 3A. With reference to FIG. 3A and FIG. 3B, the display driver 120 of this embodiment includes an image data processor unit 122, an image compression unit 124 and an image decompression unit 128. The image data processor unit 122, the image compression unit 124 and the image decompression unit 128 are disposed in the display driver 120 of the display apparatus 100. In this embodiment, an image input unit 132 is, for example, an image source outside the display driver 120, which is configured to output a first image data D1*b* to the image data processor unit 122. The first image data D1*b* represents the input frame VIN, which is inputted to the image data processor unit 122. In an embodiment, the display driver 120 is, for example, an integrated display driving chip for driving a small or medium size panel, and the integrated display driving chip includes a timing controller circuit and a source driving circuit. In this case, the image data processor unit 122 is, for example, disposed in the timing controller circuit, and the display apparatus 100 may include an application processor to serve as the image input unit 132. In another embodiment, the display driver 120 includes, for example, a timing controller chip and a data driver chip (without being integrated into one single chip), and the image data processor unit 122 is, for example, disposed in the timing controller chip.

In this embodiment, the image data processor unit 122 includes an image enhancement unit 121 and a sub-pixel rendering operation unit 123. The image enhancement unit 121 receives the first image data D1*b*. The image enhancement unit 121 is, for example, configured to enhance boundary regions between object and object or between object and background in images so as to bring out the boundary regions so they can be easily determined thereby improving an image quality. The image enhancement unit 121 may also include a related image processing for adjusting image color or luminance. In this embodiment, the sub-pixel rendering operation unit 123 receives the first image data D1*b* processed by the image enhancement unit 121. The sub-pixel rendering operation unit 123 is configured to perform the sub-pixel rendering operation on the first image data D1*b* (the input frame VIN) to generate a second image data D2*b* (the output frame VOUT). In an embodiment, it is also possible that the sub-pixel rendering operation unit 123 can directly receive the first image data D1*b* from the image input unit 132 without going through the image enhancement unit 121. In other words, the image enhancement unit 121 may be disposed according to actual design requirements, and the image data processor unit 122 may include the image enhancement unit 121 or not.

In this embodiment and the following embodiments, each sub-pixel data in the first image data D1*b* received by the image data processor unit 122 is a gray level value, whereas a sub-pixel data processed by the sub-pixel rendering operation unit 123 is a luminance value instead of the gray level value. Therefore, the sub-pixel rendering operation unit 123 may also include an operation of converting the sub-pixel in the received first image data D1*b* (or the image data processed by the image enhancement unit 121) from the gray level value into the luminance value so the sub-pixel rendering operation can be performed subsequently. In this embodiment and the following embodiments, because each sub-pixel data in the second image data D2*b* generated after the sub-pixel rendering operation is performed by the sub-pixel rendering operation unit 123 is the luminance value, the sub-pixel rendering operation unit 123 may also include an operation of converting the luminance value into the gray level value followed by outputting the second image data D2*b* with data content being the gray level value. Although the operations of converting the gray level value into the luminance value and converting the luminance value into the gray level value are not shown in the schematic diagram of each of the following embodiments, person skilled in the art should be able to understand a processed image data type is the gray level value or the luminance value according to each unit block.

In this embodiment, the sub-pixel rendering operation unit 123 outputs the second image data D2*b* (the output frame VOUT) to the image compression unit 124. The image compression unit 124 is configured to compress the second image data D2*b* to generate a third image data D3*b* (i.e., the image data obtained by compressing the output frame VOUT), and the image compression unit 124 outputs the third image data D3*b* to the image decompression unit 128. The image decompression unit 128 receives the third image data D3*b* from the image compression unit 124, and decompresses each of the third image data D3*b* to obtain each of the corresponding second image data D2*b*. In this embodiment, the display driver 120 generates a corresponding data voltage according to the output frame VOUT for driving the display panel 110 to display image frames.

In the embodiment of FIG. 3A and FIG. 3B, the sub-pixel rendering operation unit 123 performs the sub-pixel rendering operation on the first image data D1*b* to generate the second image data D2*b*. The second image data D2*b* is compressed to generate the third image data D3*b*. Compared to a data quantity of the first image data D1*b*, the data quantities of the second image data D2*b* and the third image data D3*b* may be reduced. In this way, a transmission bandwidth between the image compression unit 124 and the image decompression unit 128 may be reduced.

Figure 4:
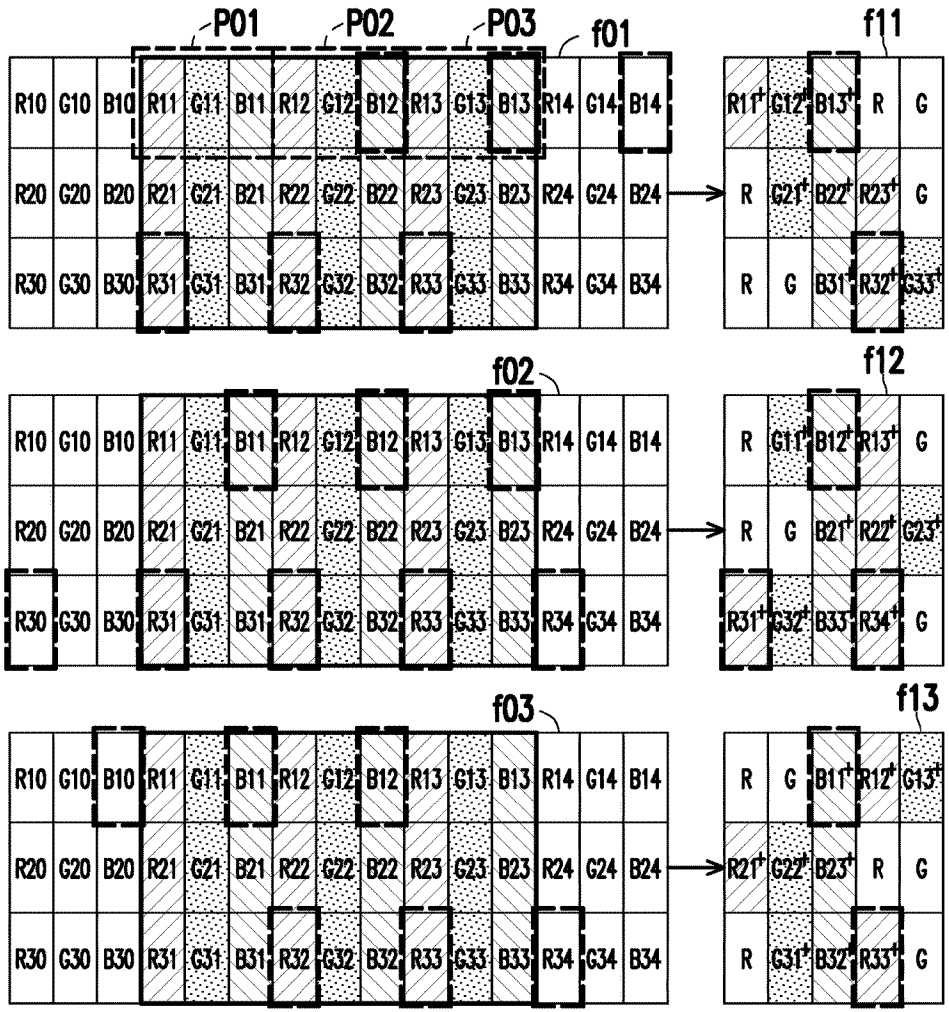
FIG. 4 is a schematic diagram illustrating a sub-pixel rendering operation in an embodiment of the invention.

FIG. 4 is a schematic diagram illustrating a sub-pixel rendering operation in an embodiment of the invention. With reference to FIG. 4, in this embodiment, the input frame VIN represents each input frame among input frames f01 to f03. Among them, the input frame f02 is an input frame temporally subsequent to the input frame f01, and the rest of cycles can be deduced by analogy. The output frame VOUT represents each output frame among output frames f11 to f13. In this embodiment, each three input frames are used as one cycle. For instance, the input frames f01, f02 and f03 are included in one cycle, the input frames f02, f03 and f04 are included in another cycle, and the rest of the cycles may be derived by analogy. The input frame f04 is an input frame temporally subsequent to the input frame f03, which is not illustrated in FIG. 4. The sub-pixel rendering operation unit 123 sequentially receives the input frames f01 to f03, and the sub-pixel rendering operation unit 123 generates the corresponding output frames f11 to f13 respectively according to each of the input frames f01 to f03. In the following embodiments, among input and output sub-pixel data symbols, R denotes a red sub-pixel data; G denotes a green sub-pixel data; and B denotes a blue sub-pixel data.

In this embodiment, for a blue sub-pixel 116B in a first pixel row of the display panel 11A, the sub-pixel rendering operation unit 123 of the image data processor unit 122 performs the sub-pixel rendering operation on input sub-pixel data B12, B13 and B14 (which are regarded as a first part of input sub-pixel data) of the input frame f01 (a first input frame) to generate an output sub-pixel data B13+ (a first output sub-pixel data) corresponding to the blue sub-pixel 116B in the output frame f11 (a first output frame). The sub-pixel rendering operation unit 123 performs the sub-pixel rendering operation on input sub-pixel data B11, B12 and B13 (which are regarded as a second part of input sub-pixel data) of the input frame f02 (a second input frame) to generate an output sub-pixel data B12+ (a second output sub-pixel data) corresponding to the blue sub-pixel 116B in the output frame f12 (a second output frame). Further, the sub-pixel rendering operation unit 123 performs the sub-pixel rendering operation on input sub-pixel data B10, B11 and B12 of the input frame f03 to generate an output sub-pixel data B11+ corresponding to the blue sub-pixel 116B in the output frame f13. In this embodiment, the output sub-pixel data B13+, B12+ and B11+ are the sub-pixel data which are sequentially written to the blue sub-pixel 116B. In this embodiment, data positions of the input sub-pixel data B12, B13 and B14 in the input frame f01 and data positions of the input sub-pixel data B11, B12 and B13 in the input frame f02 are partially overlapped and not totally the same. In detail, the data positions of the input sub-pixel data B12 and B13 are overlapped in the input frames f01 and f02. Further, the data positions of the sub-pixel data B14 included by the first part of input sub-pixel data of the input frame f01 and the sub-pixel data B11 included by the second part of input sub-pixel data of the input frame f02 are not same. Similarly, in this embodiment, the data positions of the input sub-pixel data B11, B12 and B13 in the input frame f02 and the data positions of the input sub-pixel data B10, B11 and B12 in the input frame f03 are partially overlapped and not totally the same.

In this embodiment, the sub-pixel rendering operation unit 123 performs the sub-pixel rendering operation on the input sub-pixel data by using, for example, a sub-pixel rendering filter. For generating the output sub-pixel data B13+ of the output frame f11, a center point of the sub-pixel rendering filter (i.e., a center sub-pixel position) is the input sub-pixel data B13, and boundaries of a sub-pixel data rendering range of the sub-pixel rendering filter are the input sub-pixel data B12 and B14. That is to say, the sub-pixel data rendering range covers a left input sub-pixel data B12 and a right input sub-pixel data B14 based on the center sub-pixel data B13. The number of sub-pixel data in the sub-pixel rendering range is adjustable, and the invention is not limited in this regard. For example, the sub-pixel rendering range may also be based on the center sub-pixel data B13 and expanded to include two input sub-pixel data of the same color on the left side of the center sub-pixel data and two input sub-pixel data of the same color on the right side of the center sub-pixel data. In this case, the boundaries of the sub-pixel rendering range are the input sub-pixel data B11 and B15. For the output sub-pixel data B12+ of the output frame f12, the center point of the sub-pixel rendering filter is the input sub-pixel data B12, and the boundaries of the sub-pixel data rendering range of the sub-pixel rendering filter are the input sub-pixel data B11 and B13. That is to say, the sub-pixel data rendering range covers a left input sub-pixel data B11 and a right input sub-pixel data B13 based on the center sub-pixel data B12. For the output sub-pixel data B11+ of the output frame f13, the center point of the sub-pixel rendering filter is the input sub-pixel data B11, and the boundaries of the sub-pixel data rendering range of the sub-pixel rendering filter are the input sub-pixel data B10 and B12. That is to say, the sub-pixel data rendering range covers a left input sub-pixel data B10 and a right input sub-pixel data B12 based on the center sub-pixel data B11. In other words, in this embodiment, for the two input frames which are one temporally subsequent to the other, the sub-pixel rendering filter uses different center sub-pixel positions and the same number of the sub-pixels in the sub-pixel rendering range for each of the corresponding sub-pixel rendering operations.

In this embodiment, the sub-pixel rendering operation unit 123 performs the sub-pixel rendering operation on the input sub-pixel data B12, B13 and R14 of the input frame f01 to generate the output sub-pixel data B13+ of the output frame f11. In this embodiment, the output sub-pixel data B13+ of the output frame f11 may be obtained by calculation according to a set of color diffusion ratios $$\left(\frac{1}{3}, \frac{1}{3}, \frac{1}{3}\right): B13^{+} = \frac{1}{3}B12 + \frac{1}{3}B13 + \frac{1}{3}B14.$$

Similarly, in this embodiment, the output sub-pixel data B12+ of the output frame f12 may be obtained by calculation according to the set of color diffusion ratios $$\left(\frac{1}{3}, \frac{1}{3}, \frac{1}{3}\right): B12^{+} = \frac{1}{3}B11 + \frac{1}{3}B12 + \frac{1}{3}B13,$$

and the output sub-pixel data B11+ of the input frame f13 may be obtained by calculation according to the set of color diffusion ratios $$\left(\frac{1}{3}, \frac{1}{3}, \frac{1}{3}\right): B11^{+} = \frac{1}{3}B10 + \frac{1}{3}B11 + \frac{1}{3}B12.$$

As another example, in this embodiment, for a red sub-pixel 116R in a third pixel row of the display panel 110A, the sub-pixel rendering filter of the sub-pixel rendering operation unit 123 generates output sub-pixel data R32+, R34+ and R33+ of the output frames f11, f12 and f13 by respectively using different center sub-pixel positions (i.e., positions of input sub-pixel data R32, R34 and R33) and the same number of the sub-pixels in the sub-pixel rendering range for the input frames f01, f02 and f03. The output sub-pixel data R32+ of the output frame f11 may be obtained by calculation according to the set of color diffusion ratios $$\left(\frac{1}{3}, \frac{1}{3}, \frac{1}{3}\right): R32^{+} = \frac{1}{3}R31 + \frac{1}{3}R32 + \frac{1}{3}R33.$$

The output sub-pixel data R34+ of the output frame f12 may be obtained by calculation according to the set of color diffusion ratios $$\left(\frac{1}{3}, \frac{1}{3}, \frac{1}{3}\right): R34^{+} = \frac{1}{3}R33 + \frac{1}{3}R34 + \frac{1}{3}R35$$

(R35 is not illustrated in FIG. 4 but may be deduced by analogy). The output sub-pixel data R33+ of the output frame f13 may be obtained by calculation according to the set of color diffusion ratios $$\left(\frac{1}{3}, \frac{1}{3}, \frac{1}{3}\right): R33^{+} = \frac{1}{3}R32 + \frac{1}{3}R33 + \frac{1}{3}R34.$$

The output sub-pixel data R32+, R34+ and R33+ respectively in the output frames f11, f12 and f13 are sequentially written into the red sub-pixel 116R in the third pixel row of the display panel 110A. The output sub-pixel data $$R31+\left(R31^{+} = \frac{1}{3}R30 + \frac{1}{3}R31 + \frac{1}{3}R32\right)$$

in the output frame f12 is obtained by performing the sub-pixel rendering operation with the input sub-pixel data R31 in the input frame f02 as the center sub-pixel position, and the output sub-pixel data R31+ are written into another red sub-pixel on the left of the red sub-pixel 116R.

In this embodiment, the method used by the sub-pixel rendering operation unit 123 for generating the output sub-pixel data of the corresponding output frame by performing the sub-pixel rendering operation on other part of input sub-pixel data of each input frame may be deduced by analogy with reference to the method for generating the output sub-pixel data B13+, B12+, B11+, R32+, R34+ and R33+ described above.

Figure 5A:
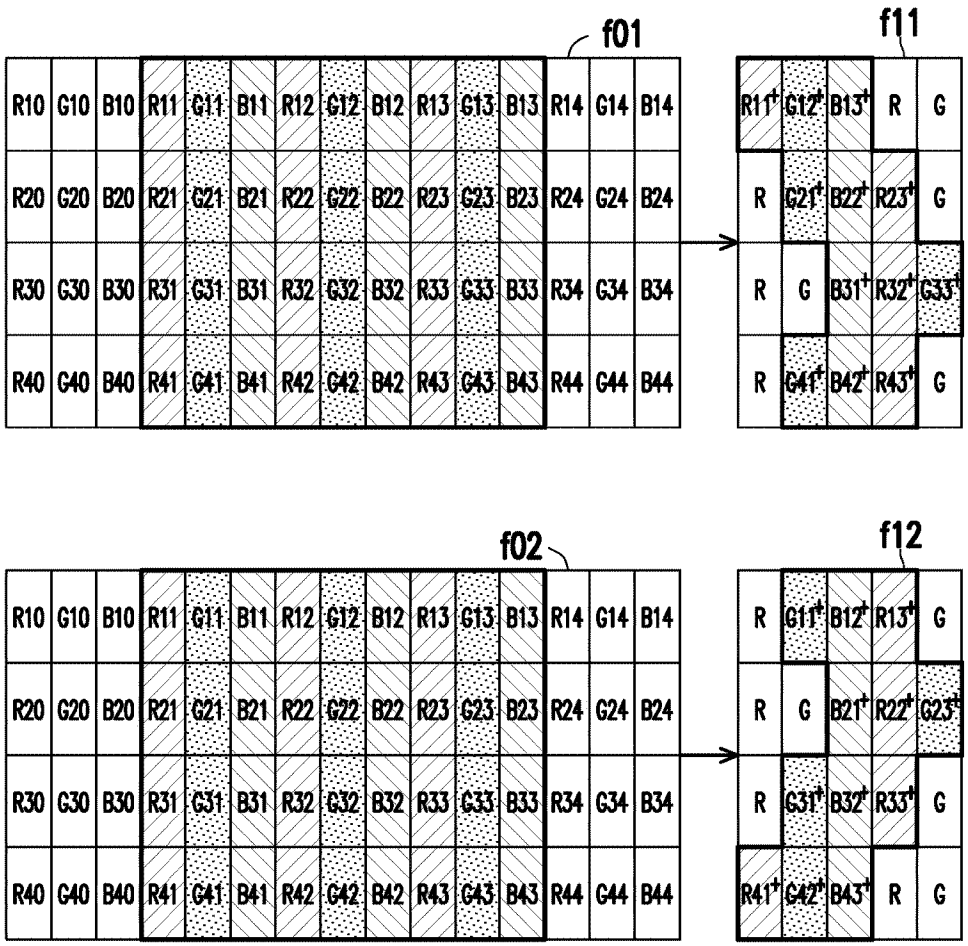
FIG. 5A and FIG. 5B are schematic diagrams illustrating a sub-pixel rendering operation in another embodiment of the invention.
Figure 5B:
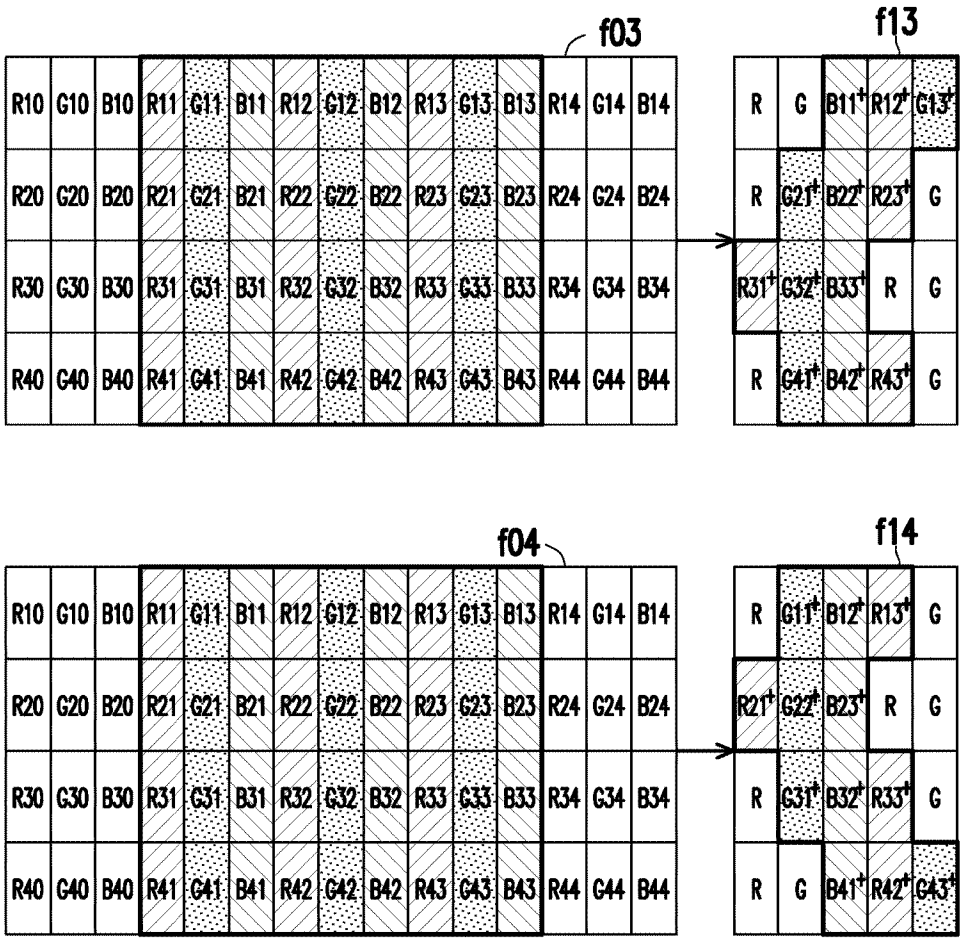

For this embodiment of FIG. 4 and the following embodiment of FIG. 5A and FIG. 5B in which the sub-pixel rendering range is based on the center sub-pixel data and expanded to include one input sub-pixel data of the same color on the left side of the center sub-pixel data and one input sub-pixel data of the same color on the right side of the center sub-pixel data, one of features in the performed sub-pixel rendering operation is: for each output pixel data in one output frame, each of the output sub-pixel data therein is generated based on an input sub-pixel data at different input pixel data as the center point of the sub-pixel rendering filter. Taking FIG. 4 as an example, in the output frame f11, a sub-pixel data R11+ is generated based on a sub-pixel data R11 in a pixel data P01 in the input frame f01 as the center sub-pixel data position; a sub-pixel data G12+ is generated based on a sub-pixel data G12 in a pixel data P02 in the input frame f01 as the center sub-pixel data position; a sub-pixel data B13+ is generated based on a sub-pixel data B13 in a pixel data P03 in the input frame f01 as the center sub-pixel data. For each input frame, each pixel data includes three sub-pixel data, only one of the sub-pixel data would be used as the center sub-pixel position in the sub-pixel rendering operation, and the other two sub-pixel data would not be used as the center sub-pixel position but simply used as data within the sub-pixel rendering range. For instance, in the pixel data P01 of the input frame f01, the sub-pixel rendering operation is performed with only the sub-pixel data R11 used as the center sub-pixel position to generate the sub-pixel data R11+ of the output frame f11. The sub-pixel data G11 or the sub-pixel data B11 is simply the data within the sub-pixel rendering range and is not used as the center sub-pixel position.

In this embodiment, the sub-pixel rendering operation unit 123 performs the sub-pixel rendering operation on each of the input frames f01, f02 and f03 based on three pixel rows, and only one sub-pixel data in each input pixel data is used as the center point of the sub-pixel rendering filter. However, the invention is not limited in this regard. In the subsequent embodiments, it is also possible that two sub-pixel data (instead of only one) in each input pixel data of the input frame are respectively used as the center point of the sub-pixel rendering filter. In addition, in this embodiment, the output sub-pixel data generated according to a fixed data size in the input frames f01, f02 and f03 such as 3*3 input pixel data (e.g., the pixel data marked with dots or slashes in FIG. 4) are arranged in a zigzag manner in the output frames f11, f12 and f13.

FIG. 5A and FIG. 5B are schematic diagrams illustrating a sub-pixel rendering operation in another embodiment of the invention. In this embodiment, the sub-pixel rendering operation unit 123 performs the sub-pixel rendering operation on each of the input frames f01, f02, f03 and f04 based on four pixel rows, and only one sub-pixel data in each input pixel data is used as the center point of the sub-pixel rendering filter. Each four input frames are used as one cycle. In addition, in this embodiment, the output sub-pixel data generated according to a fixed data size in the input frames f01, f02, f03 and f04 such as 4*3 input pixel data (e.g., the pixel data marked with dots or slashes in FIG. 4) are arranged in a zigzag manner in the output frames f11, f12, f13 and f14. In this embodiment, the method used by the sub-pixel rendering operation unit 123 for generating the output sub-pixel data of the corresponding output frame by performing the sub-pixel rendering operation on other input sub-pixel data of each input frame may be deduced by analogy with reference to the generating method disclosed in the embodiment of FIG. 4.

Figure 6:
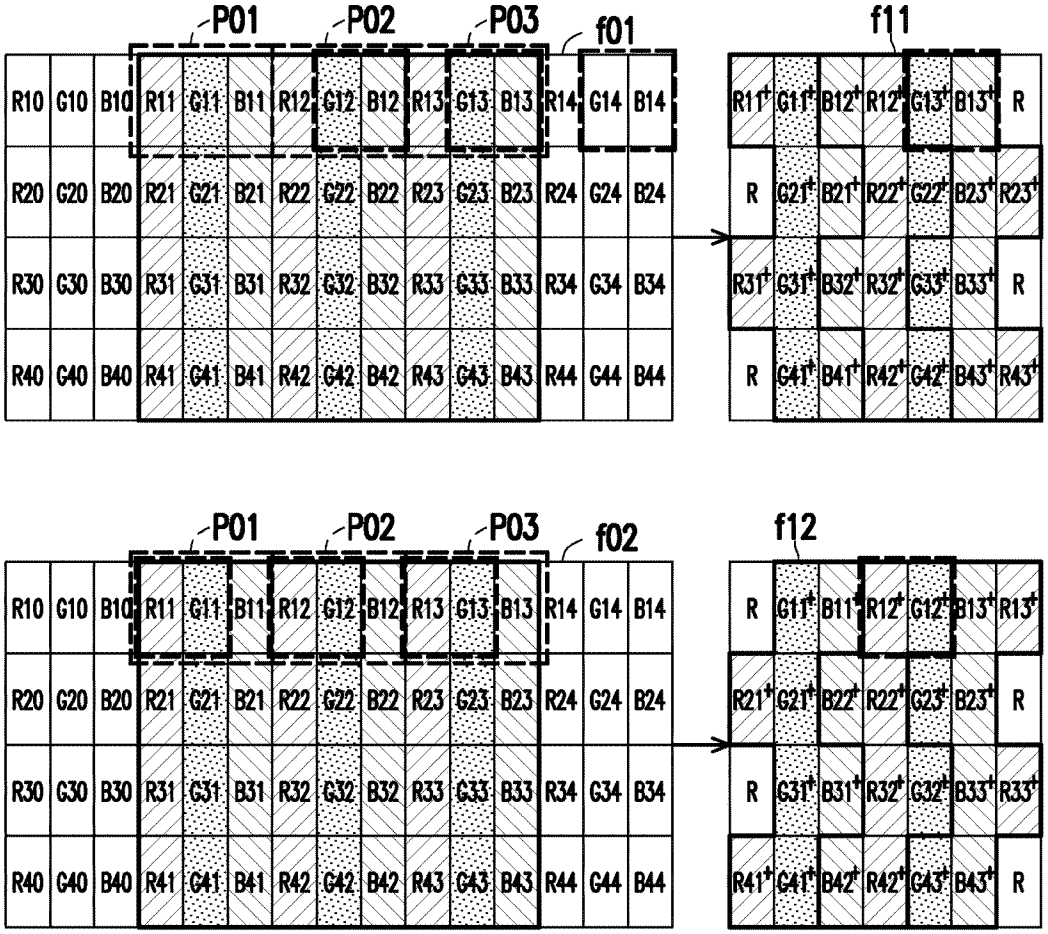
FIG. 6 is a schematic diagram illustrating a sub-pixel rendering operation in another embodiment of the invention.

FIG. 6 is a schematic diagram illustrating a sub-pixel rendering operation in another embodiment of the invention. In this embodiment, the sub-pixel rendering operation unit 123 performs the sub-pixel rendering operation on each of the input frames f01 and f02 based on four pixel rows, and two sub-pixel data in each input pixel data are respectively used as the center point of the sub-pixel rendering filter. Each two input frames are used as one cycle. For instance, the sub-pixel data G13 and B13 in the input pixel data P03 in the input frame f01 are respectively used as the center point of the sub-pixel rendering filter; the output sub-pixel data G13+ of the output frame f11 is generated based on the sub-pixel data G13 in the input frame f01 as the center point of the sub-pixel rendering filter, i.e., $$G13^{+} = \frac{1}{3}G12 + \frac{1}{3}G13 + \frac{1}{3}G14;$$

the output sub-pixel data B13+ of the output frame f11 is generated based on the sub-pixel data B13 in the input frame f01 as the center point of the sub-pixel rendering filter, $$B13^{+} = \frac{1}{3}B12 + \frac{1}{3}B13 + \frac{1}{3}B14.$$

In this embodiment, the method used by the sub-pixel rendering operation unit 123 for generating the corresponding output sub-pixel data in the output frame f11 by performing the sub-pixel rendering operation on other input sub-pixel data of the input frame f01 may be deduced by analogy with reference to the method for generating the output sub-pixel data G13+ and B13+ described above.

As another example, the sub-pixel data R12 and G12 in the input pixel data P02 in the input frame f02 are respectively used as the center point of the sub-pixel rendering filter; the output sub-pixel data R12+ of the output frame f12 is generated based on the sub-pixel data R12 as the center point of the sub-pixel rendering filter, i.e., $$R12^{+} = \frac{1}{3}R11 + \frac{1}{3}R12 + \frac{1}{3}R13;$$

the output sub-pixel data G12+ of the output frame f12 is generated based on the sub-pixel data G12 as the center point of the sub-pixel rendering filter, i.e., $$G12^{+} = \frac{1}{3}G11 + \frac{1}{3}G12 + \frac{1}{3}G13.$$

In this embodiment, the method used by the sub-pixel rendering operation unit 123 for generating the corresponding output sub-pixel data in the output frame f12 by performing the sub-pixel rendering operation on other input sub-pixel data of the input frame f02 may be deduced by analogy with reference to the method for generating the output sub-pixel data R12+ and G12+ described above.

In addition, in this embodiment, the output sub-pixel data generated according to a fixed data size in the input frames f01 and f02 such as 4*3 input pixel data are arranged in a zigzag manner in the output frames f11 and f12.

Figure 7A:
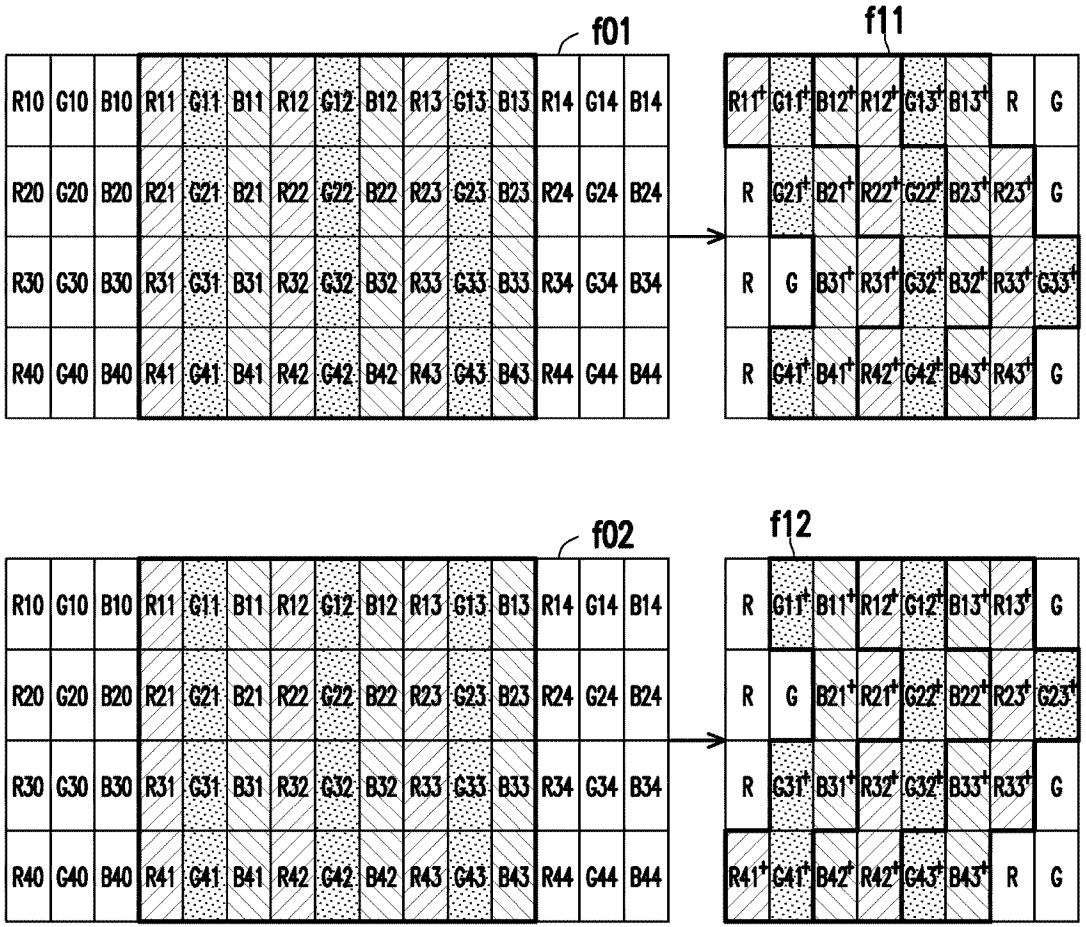
FIG. 7A and FIG. 7B are schematic diagrams illustrating a sub-pixel rendering operation in another embodiment of the invention.
Figure 7B:
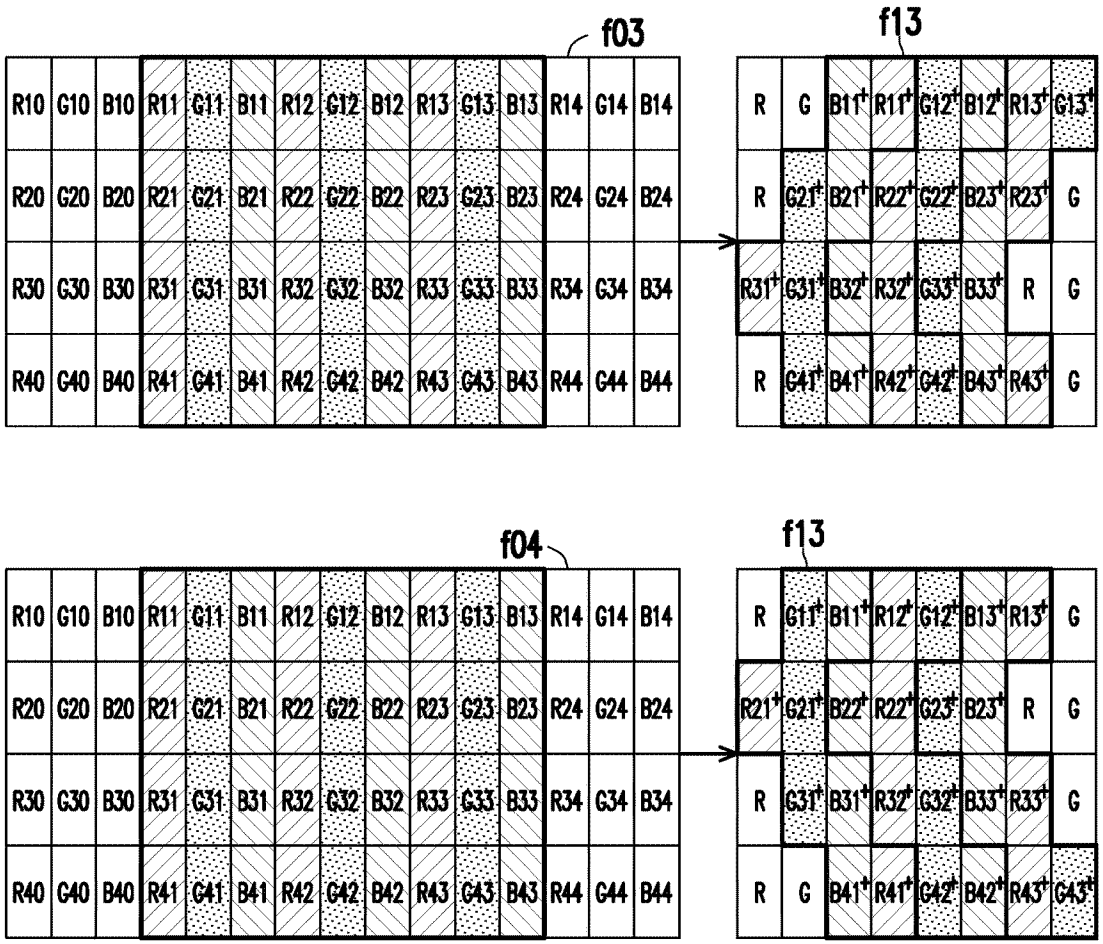

FIG. 7A and FIG. 7B are schematic diagrams illustrating a sub-pixel rendering operation in another embodiment of the invention. In this embodiment, the sub-pixel rendering operation unit 123 performs the sub-pixel rendering operation on each of the input frames f01, f02, f03 and f04 based on four pixel rows, and two sub-pixel data in each pixel data are respectively used as the center point of the sub-pixel rendering filter. Each four input frames are used as one cycle. In addition, in this embodiment, the output sub-pixel data generated according to a fixed data size in the input frames f01, f02, f03 and f04 such as 4*3 input pixel data are arranged in a zigzag manner in the output frames f11, f12, f13 and f14. In this embodiment, the method used by the sub-pixel rendering operation unit 123 for generating the output sub-pixel data of the corresponding output frame by performing the sub-pixel rendering operation on other input sub-pixel data of each input frame may be deduced by analogy with reference to the generating method disclosed in the embodiment of FIG. 6.

In view of the above, for the embodiments of FIG. 6, FIG. 7A and FIG. 7B in which the sub-pixel rendering range is based on the center sub-pixel data and expanded to include two input sub-pixel data of the same color on the left side of the center sub-pixel data and two input sub-pixel data of the same color on the right side of the center sub-pixel data, one of features in the performed sub-pixel rendering operation is: for each output pixel data in one output frame, two output sub-pixel data therein are respectively generated based on input sub-pixel data in the same input pixel data as the center point of the sub-pixel rendering filter.

Figure 8A:
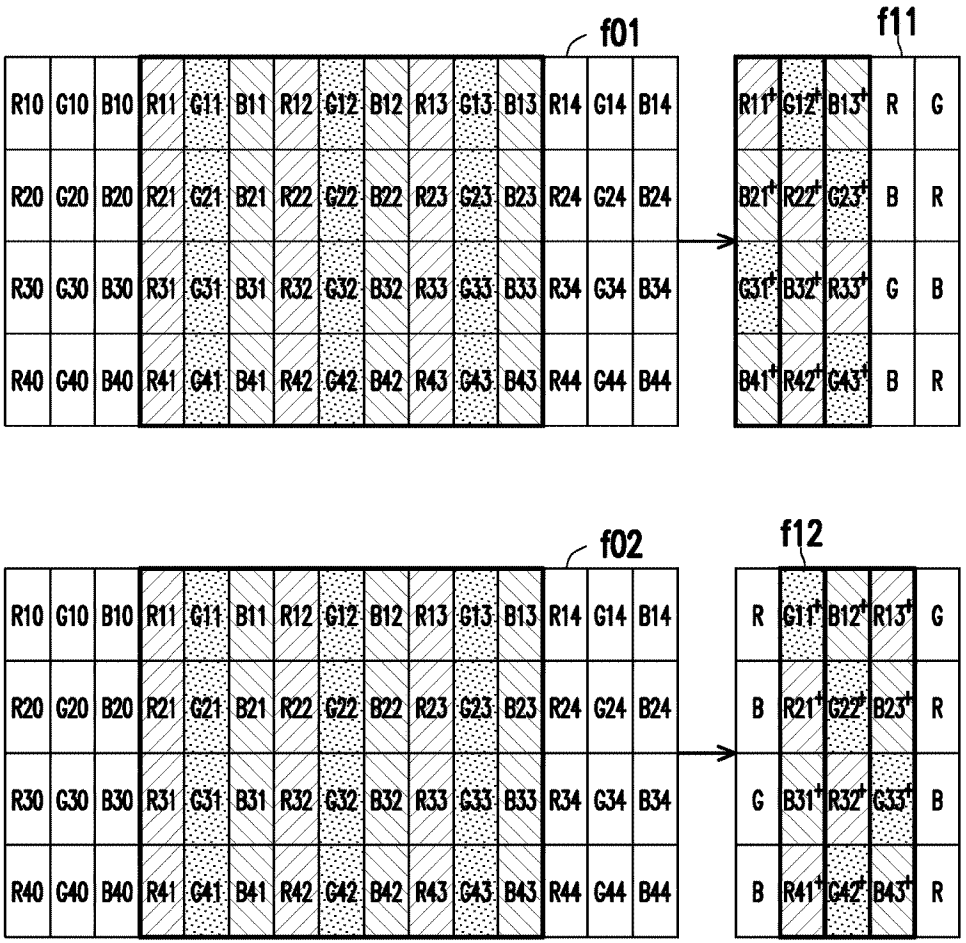
FIG. 8A and FIG. 8B are schematic diagrams illustrating a sub-pixel rendering operation in another embodiment of the invention.
Figure 8B:
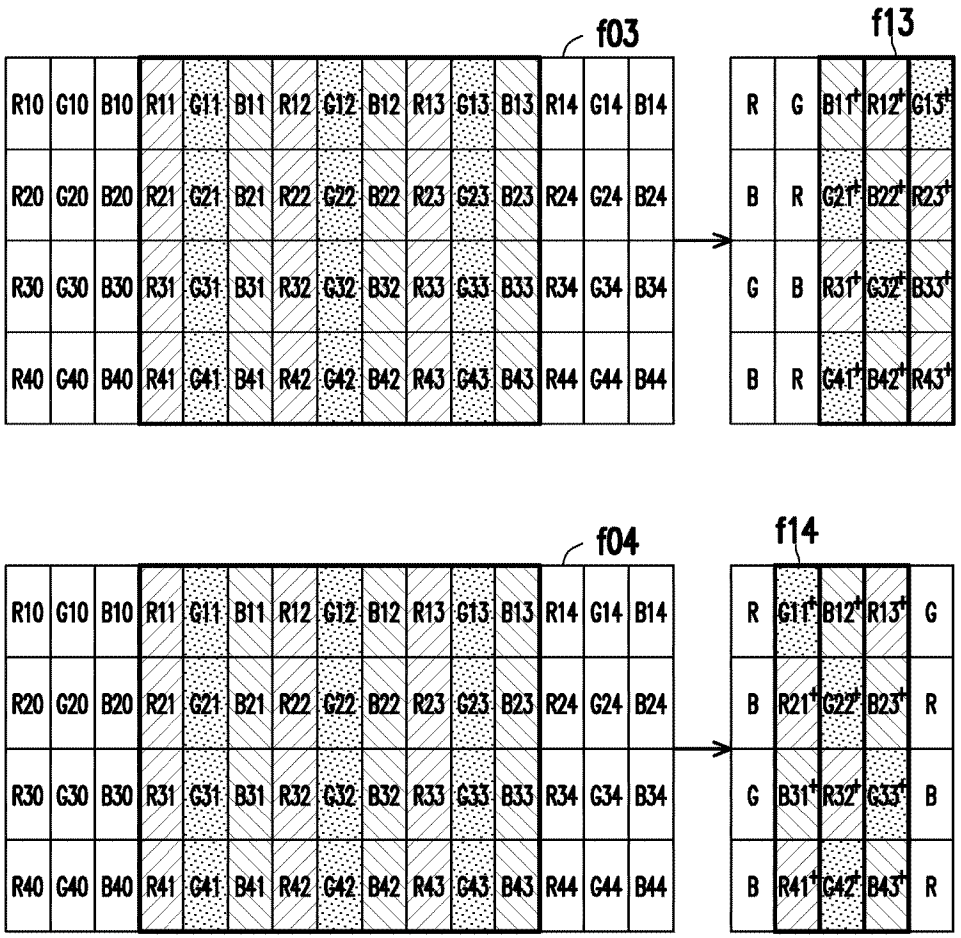

The output frames generated by the sub-pixel rendering operation according to FIG. 4 to FIG. 7B may be written into a full color display panel with RGB stripe type. Nonetheless, the type of the panel to be written with the generated output frames according to other embodiments of the invention is not limited to the above. FIG. 8A and FIG. 8B are schematic diagrams illustrating a sub-pixel rendering operation in another embodiment of the invention. In this embodiment, the output frames f11, f12, f13 and f14 are written into a sub-pixel rendering panel (SPR panel) that adopts a sub-pixel rendering arrangement. In this embodiment, the sub-pixel rendering operation unit 123 performs the sub-pixel rendering operation on each of the input frames f01, f02, f03 and f04 based on four pixel rows, and only one sub-pixel data in each input pixel data is used as the center point of the sub-pixel rendering filter. In this embodiment, each four input frames are used as one cycle. In this embodiment, the method used by the sub-pixel rendering operation unit 123 for generating the output sub-pixel data of the corresponding output frame by performing the sub-pixel rendering operation on other input sub-pixel data of each input frame may be deduced by analogy with reference to the generating method disclosed in the embodiment of FIG. 4.

Figure 9:
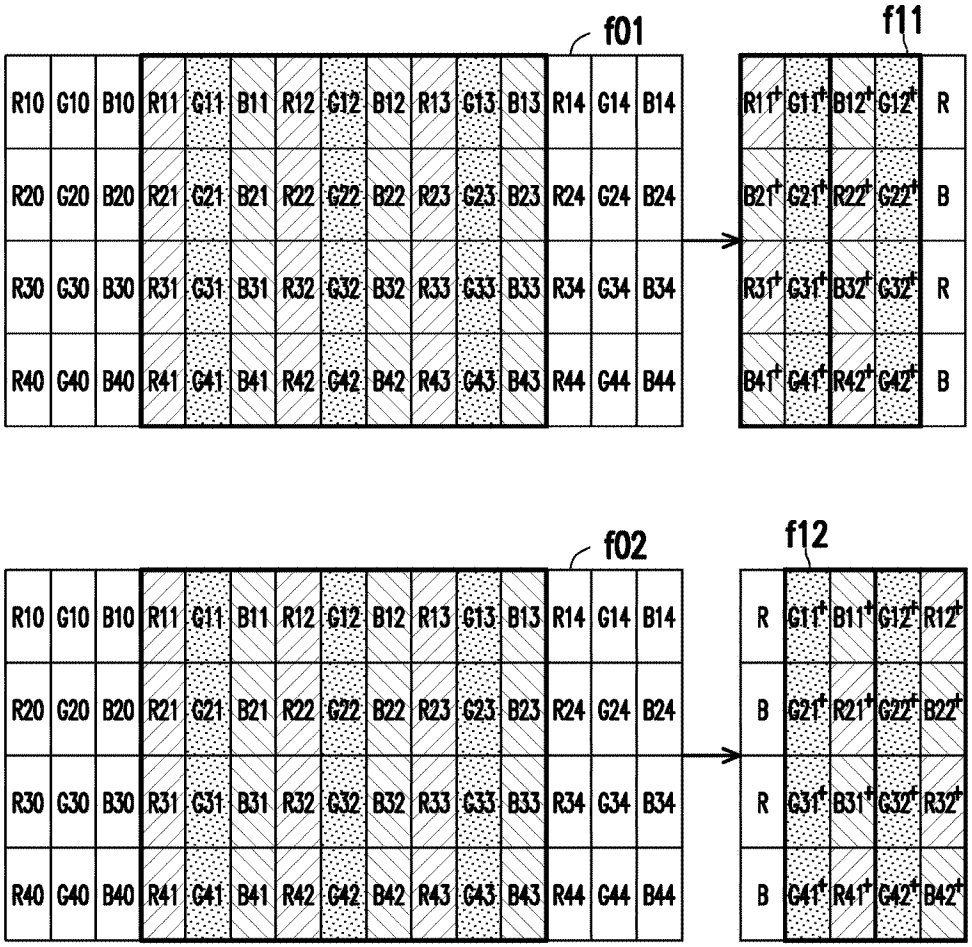
FIG. 9 is a schematic diagram illustrating a sub-pixel rendering operation in another embodiment of the invention.

FIG. 9 is a schematic diagram illustrating a sub-pixel rendering operation in another embodiment of the invention. In this embodiment, the sub-pixel rendering operation unit 123 performs the sub-pixel rendering operation on each of the input frames f01 and f02 based on four pixel rows, and two sub-pixel data in each pixel data are respectively used as the center point of the sub-pixel rendering filter. In this embodiment, each two input frames are used as one cycle. In this embodiment, the method used by the sub-pixel rendering operation unit 123 for generating the output sub-pixel data of the corresponding output frame by performing the sub-pixel rendering operation on other input sub-pixel data of each input frame may be deduced by analogy with reference to the generating method disclosed in the embodiment of FIG. 6. In this embodiment, the output frames f11 and f12 are written into a sub-pixel rendering panel corresponding to the sub-pixel data arrangement.

Figure 10:
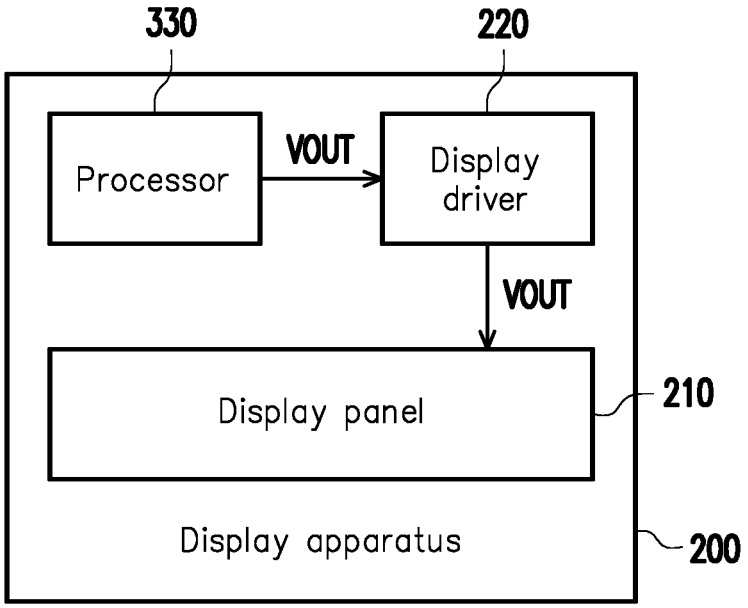
FIG. 10 is a schematic diagram illustrating an image processing apparatus in another embodiment of the invention.
Figure 11:
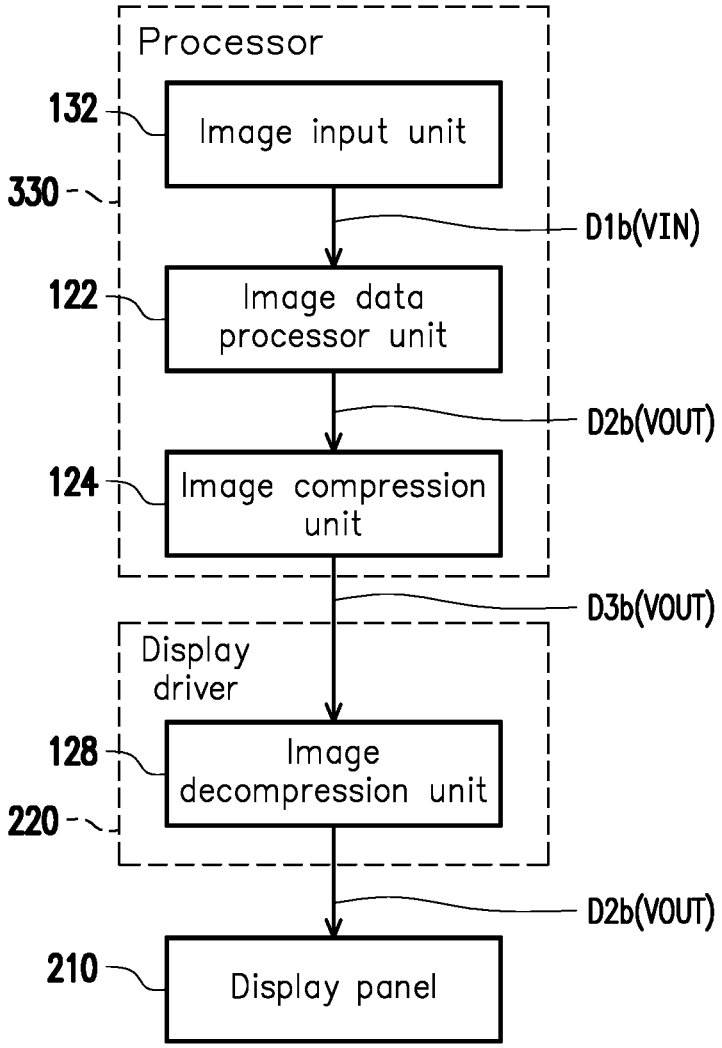
FIG. 11 is a schematic diagram of a display driver and a processor in the embodiment of FIG. 10.

FIG. 10 is a schematic diagram illustrating a display apparatus in an embodiment of the invention. FIG. 11 is a schematic diagram of a display driver and a processor in the embodiment of FIG. 10. With reference to FIG. 10 and FIG. 11, a display apparatus 300 of this embodiment includes a display panel 210, a display driver 220 and the processor 330. In an embodiment, the processor 330 is, for example, an application processor (AP). In this embodiment, the display apparatus 200 is, for example, an electronic apparatus having a display function, such a cell phone, a tablet computer or a camera.

In this embodiment, the processor 330 includes the image input unit 132, the image data processor unit 122 and the image compression unit 124. The display driver 220 includes the image data processor unit 128. The display driver 220 is configured to receive the third image data D3*b* from the processor 330, and drive the display panel 210 according to the decompressed second image data D2*b*. In this embodiment, the image data processor unit 122 performs the sub-pixel rendering operation described in the embodiments of the invention on the first image data D1*b* to generate the second image data D2*b*. The second image data D2*b* is compressed to generate the third image data D3*b*. Compared to a data quantity of the first image data D1*b*, the data quantities of the second image data D2*b* and the third image data D3*b* may be reduced. In an embodiment, the processor 330 is used as a data transmitter, and the display driver 220 is used as a data receiver. In this way, a transmission bandwidth between the processor 330 (the data transmitter) and the display driver 220 (the data receiver) may be reduced.

In this embodiment, after compressing the second image data D2*b*, the image compression unit 124 generates the third image data D3*b* to be transmitted to the image decompression unit 128. Subsequently, after decompressing the third image data D3*b*, the image decompression unit 128 generates the second image data D2*b*, which is used to drive the display panel 210. In this embodiment, it is not required to have the second image data D2*b* (the output frame VOUT) outputted by the image data processor unit 122 reconstructed but simply converted into data voltages by the display driver 220 for driving the display panel 210. In other words, the display panel 210 may be driven according to each of the output frames described in FIG. 4 to FIG. 9 without going through reconstruction.

In addition, sufficient teaching, suggestion, and implementation regarding an operation method of the image processing apparatus and the method for generating the display data of the display panel of this embodiment the invention may be obtained from the foregoing embodiments of FIG. 1 to FIG. 4, and thus related descriptions thereof are not repeated hereinafter.

Figure 12:
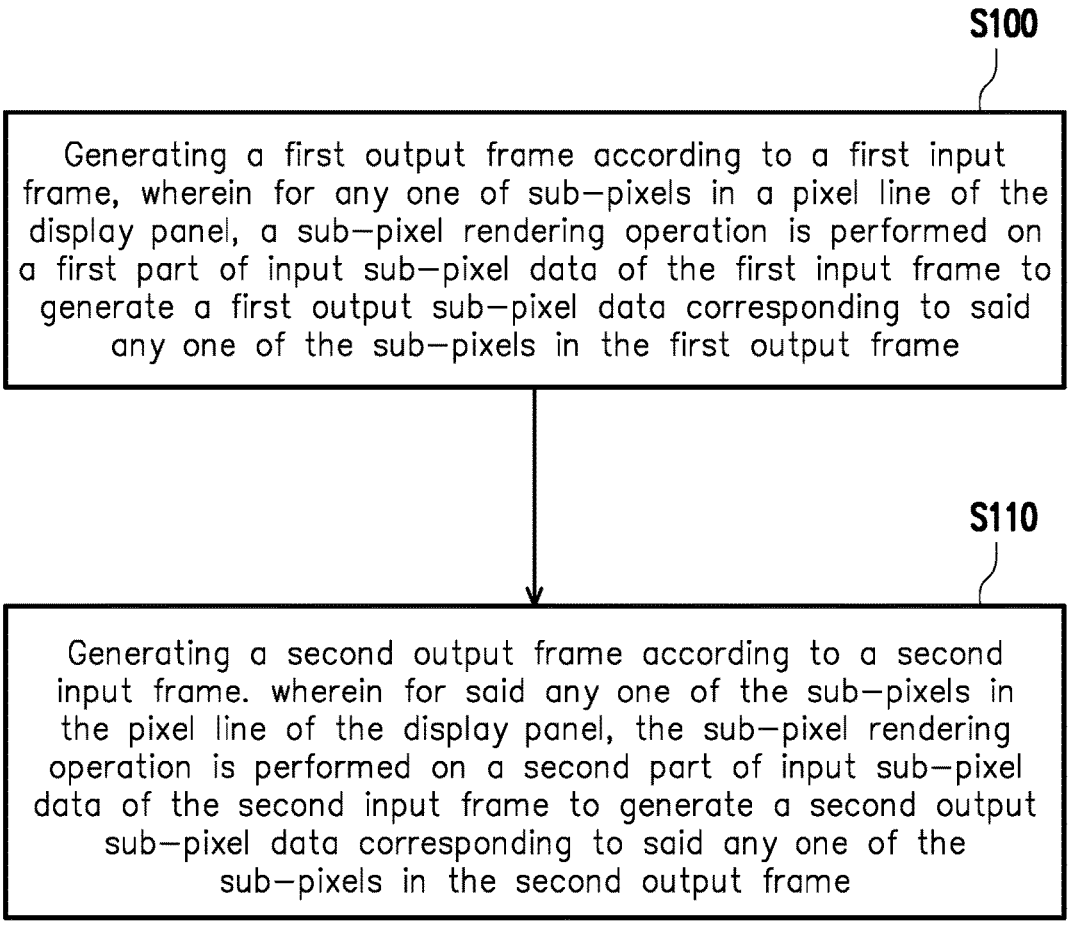
FIG. 12 is a flowchart illustrating a method for generating a display data of a display panel in an embodiment of the invention.

FIG. 12 is a flowchart illustrating a method for generating a display data of a display panel in an embodiment of the invention. The method for generating the display data of this embodiment is at least adapted to the display apparatus 100 of FIG. 1 or the electronic apparatus 200 of FIG. 10. Taking the display apparatus 100 of FIG. 1 as an example, in step S100, a first output frame is generated according to a first input frame. Here, for any one of sub-pixels in a pixel row of the display panel 110, the display driver 120 performs a sub-pixel rendering operation on a first part of input sub-pixel data of the first input frame to generate a first output sub-pixel data corresponding to said any one of the sub-pixels in the first output frame. In step S110, the display driver 120 generates a second output frame according to a second input frame. Here, for said any one of the sub-pixels in the pixel row of the display panel, the sub-pixel rendering operation is performed on a second part of input sub-pixel data of the second input frame to generate a second output sub-pixel data corresponding to said any one of the sub-pixels in the second output frame. In addition, sufficient teaching, suggestion, and implementation regarding the method for generating the display data of the display panel in the embodiment of FIG. 12 may be obtained from the foregoing embodiments of FIG. 1 to FIG. 11, and thus related descriptions thereof are not repeated hereinafter.

In an exemplary embodiment of the invention, each of the display driver, the image enhancement unit, the image data processor unit, the image compression unit, the image decompression unit, the image input unit, the sub-pixel rendering filter and the processor may be implemented by any hardware or software in the field, which is not particularly limited in the invention. Enough teaching, suggestion, and implementation illustration for detailed implementation of the above may be obtained with reference to common knowledge in the related art, which is not repeated hereinafter.

In summary, according to the exemplary embodiments of the invention, in the display driver and the method for generating the display data of the display panel, the display processing includes the sub-pixel rendering operation. With the sub-pixel rendering operation performed by the image data processor unit on the input image data to generate the output image data, the data transmission amount of the image data in the device or between devices may be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An image processing apparatus, comprising:

an image data processor unit, configured to generate a first output frame according to a first input frame and generate a second output frame according to a second input frame, the first output frame and the second output frame being displayed on a display panel, wherein the second input frame is an input frame temporally subsequent to the first input frame, wherein for a sub-pixel in a pixel row of the display panel, the image data processing unit performs a sub-pixel rendering operation on a first part of input sub-pixel data of the first input frame to generate a first output sub-pixel data corresponding to the sub-pixel in the first output frame, and for the sub-pixel in the pixel row of the display panel, the image data processing unit performs the sub-pixel rendering operation on a second part of input sub-pixel data of the second input frame to generate a second output sub-pixel data corresponding to the sub-pixel in the second output frame, wherein data positions of the first part of input sub-pixel data in the first input frame and data positions of the second part of input sub-pixel data in the second input frame are partially overlapped and not totally the same.

2. The image processing apparatus according to claim 1, wherein the sub-pixel rendering operation comprises: calculating the first part of input sub-pixel data of the same color or the second part of input sub-pixel data of the same color by the image data processor unit according to a set of color diffusion ratios to generate the first output sub-pixel data or the second output sub-pixel data corresponding to the sub-pixel.

3. The image processing apparatus according to claim 1, further comprising:

an image compression unit, configured to compress the first output frame, compress the second output frame, and output the compressed first output frame and the compressed second output frame.

4. The image processing apparatus according to claim 3, further comprising a processor, wherein the image data processor unit and the image compression unit are disposed in the processor, and the processor outputs the compressed first output frame and the compressed second output frame to a display driver.

5. The image processing apparatus according to claim 3, further comprising:

an image decompression unit, configured to decompress the compressed first output frame and the compressed second output frame to generate the decompressed first output frame and the decompressed second output frame.

6. The image processing apparatus according to claim 5, further comprising a display driver, wherein the image data processor unit, the image compression unit and the image decompression unit are disposed in the display driver, and the display driver drives the display panel according to the decompressed first output frame and the decompressed second output frame.

7. A method for generating a display data of a display panel, comprising:

generating a first output frame according to a first input frame, wherein for a sub-pixel in a pixel row of the display panel, a sub-pixel rendering operation is performed on a first part of input sub-pixel data of the first input frame to generate a first output sub-pixel data corresponding to the sub-pixel in the first output frame; and generating a second output frame according to a second input frame, wherein for the sub-pixel in the pixel row of the display panel, the sub-pixel rendering operation is performed on a second part of input sub-pixel data of the second input frame to generate a second output sub-pixel data corresponding to the sub-pixel in the second output frame;

wherein the first output frame and the second output frame are displayed on the display panel, and the second input frame is an input frame temporally subsequent to the first input frame, wherein data positions of the first part of input sub-pixel data in the first input frame and data positions of the second part of input sub-pixel data in the second input frame are partially overlapped and not totally the same.

8. The method for generating the display data of the display panel according to claim 7, wherein the sub-pixel rendering operation comprises: calculating the first part of input sub-pixel data of the same color or the second part of input sub-pixel data of the same color according to a set of color diffusion ratios to generate the first output sub-pixel data or the second output sub-pixel data corresponding to the sub-pixel.

* * * * *